United States Patent [19]

Chermin et al.

[11] 4,253,043

[45] Feb. 24, 1981

[54] ELECTRIC ARRANGEMENT INCLUDING AT LEAST ONE GAS AND/OR VAPOR DISCHARGE TUBE

[75] Inventors: Hubertus M. J. Chermin; Jozef C. Moerkens; Adrianus M. J. De Bijl, all of Eindhoven, Netherlands

[73] Assignee: U.S. Philips Corporation, New York, N.Y.

[21] Appl. No.: 9,577

[22] Filed: Feb. 5, 1979

[30] Foreign Application Priority Data

Jun. 27, 1978 [NL] Netherlands ..... 7806889

[51] Int. Cl.[3] ..... H05B 41/16

[52] U.S. Cl. ..... 315/105; 315/101; 315/102; 315/245

[58] Field of Search ..... 315/101, 105, 106, 245, 315/360, 102

[56] References Cited

U.S. PATENT DOCUMENTS 3,924,155 12/1975 Vogeli ..... 315/105 X 3,978,368 8/1976 Tomura et al. ..... 315/101 X

FOREIGN PATENT DOCUMENTS 2255777 7/1975 France ..... 315/106

2285780 4/1976 France ..... 315/101

2345885 10/1977 France ..... 315/101

*Primary Examiner*—Eugene R. LaRoche

*Attorney, Agent, or Firm*—William J. Streeter; Bernard Franzblau

[57] ABSTRACT

The invention relates to an electric arrangement comprising two series-arranged discharge tubes which are provided with preheatable electrodes and which are stabilized by means of a relatively small ballast. The tubes are shunted by a semi-conductor switching element which operates in the operating condition of the tubes.

According to the invention a control circuit of the semiconductor switching element includes a non-linear circuit element which ensures that the discharge tubes do not ignite before the electrodes are in the warm state.

22 Claims, 2 Drawing Figures

ELECTRIC ARRANGEMENT INCLUDING AT LEAST ONE GAS AND/OR VAPOR DISCHARGE TUBE

Figure 1:
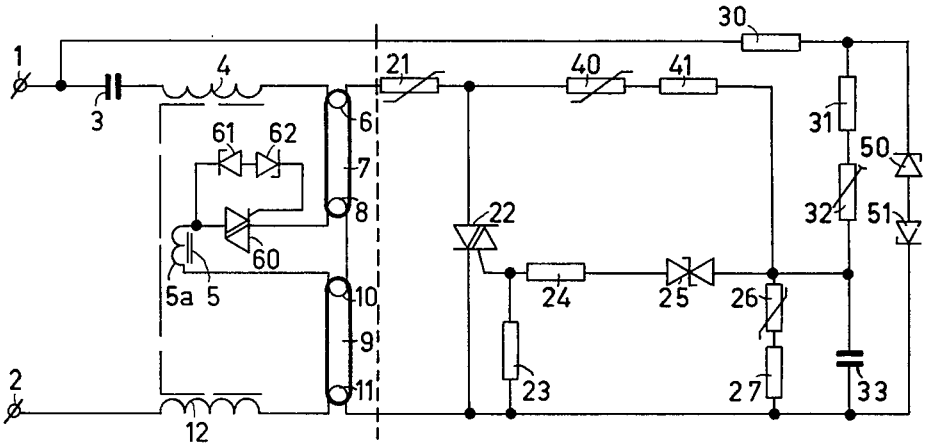

The invention relates to an electric arrangement comprising at least one gas and/or vapour discharge tube provided with a preheatable electrode and means for igniting and operating the discharged tube. The arrangement comprises two input terminals which are interconnected by a series arrangement of at least the discharge tube and stabilization ballast which includes a capacitor. The input terminals are intended for connection to an a.c. voltage source the r.m.s. voltage value in volts of which is between 0.65 VB and 1.4 VB, where VB is the total arc voltage in volts of the discharge tube(s) disposed in the series arrangement. The end of the preheatable electrode which faces away from the input terminals is connected to another tube electrode—which is included in the series arrangement—through a circuit comprising a semiconductor switching element. In the operating condition of the dischharge tube the switching element is made conductive by a control circuit in the second half of each cycle of the supply voltage. In addition, the invention relates to an auxiliary device comprising a semiconductor switching element, which auxiliary arrangement is particularly suitable for an electric device as specified above.

A known electric arrangement of the specified type is, for example, disclosed in U.S. Pat. No. 3,997,814, where the discharge tube is a lamp. An advantage of that known device is that the stabilization ballast is relatively small.

However, a disadvantage of the known electric arrangement is that during the starting procedure of the discharge tube the voltage between the tube electrodes may rise to such an extent that the discharge tube may already ignite while the preheatable electrode is still in its cold state. Such a manner of ignition has the drawback that the life of the discharge tube decreases.

It is an object of the invention to provide an electric device of the specified type wherein the discharge tube is prevented from igniting while the preheatable electrode is in the cold state.

An electric arrangement according to the invention comprises at least one gas and/or vapour discharge tube provided with a preheatable electrode, and means for igniting and feeding that dischrge tube. The arrangement has two input terminals interconnected by a series arrangement of at least the discharge tube and a stabilization ballast which includes a capacitor. The input terminals are intended for connection to an a.c. voltage source, whose r.m.s. voltage value lies between 0.65 VB and 1.4 VB, where VB is the total arc voltage in volts of the discharge tube(s) disposed in the series arrangement. The end of the preheatable electrode which faces away from the input terminals is connected to another tube electrode—which is included in the series arrangement—through a circuit comprising a semiconductor switching element, and, in the operating condition of the discharge tube, this switching element is made conductive by a control circuit in the second half of each cycle of the AC supply. The invention is characterized in that the two electrodes are also interconnected via a non-linear circuit element, when the device is switched on (i.e. receiving electric energy at the two input terminals) but the discharge tube has not yet been ignited, having a lower ohmic value than in the operating condition of the discharge tube.

An advantage of this electric arrangement is that a high voltage will not be developed between the tube electrodes during the starting procedure of the discharge tube, which is, for example, in the form of a lamp, owing to the low-ohmic state of the non-linear circuit element. This prevents ignition of the lamp while the preheatable electrode is still in the cold state, thus increasing the switching life of the discharge tube. Switching life must here be understood to mean the number of times the tube is switched on before it becomes unusuable.

In the above it is indicated that the preheatable electrode is connected to another tube electrode. The other tube electrode may be a second electrode of the said discharge tube or it may be an electrode of a second or further discharge tube which is likewise included in the series arrangement between the input terminals.

The semiconductor switching element consists, for example, of two inverse-parallel connected thyristors.

It is conceivable that an input branch of the control circuit of the semiconductor switching element is connected between the two tube electrodes.

Further the non-linear circuit element might be connected, for example directly between the two tube electrodes.

The non-linear circuit element may, for example, be a resistor having a positive temperature coefficient (PTC resistor). In that case its ohmic resistance, in the cold state of the resistor, will be low during ignition of the discharge tube, which prevents a high voltage from occurring between the electrodes of the discharge tube.

The high-ohmic state of the PTC resistor is, for example, accomplished by locating that resistor near the discharge tube, for example a low-pressure sodium vapour discharge tube, so that in its operating condition the tube keeps the PTC resistor at a relatively high temperature.

In a preferred embodiment of an electric arrangement according to the invention wherein a first input branch of the control circuit of the semiconductor switching element is connected to an input terminal of the device, the non-linear circuit element is part of a second input branch of the control circuit of the semiconductor switching element, and, in the low ohmic state of the non-linear circuit element the time constant of that portion of the control circuit which is constituted by the second input branch is so small that the semiconductor switching element is made conductive by said second input branch.

An advantage of this preferred embodiment is that the non-linear circuit element may be physically rather small as it is only present in a control circuit. Namely, it is then not necessary that the non-linear circuit element be able to pass the full current flowing through the stabilization ballast. Owing to the small time constant of that portion of the control circuit which is constituted by the second input branch, the semiconductor switching element is not made conductive during the starting procedure of the discharge tube by means of the first input branch but instead is made conductive by means of the second input branch. Of course the different voltages to which the two input branches are connected are thereby also taken into account.

In an improvement of the said preferred embodiment of an electric device according to the invention the non-linear circuit element is a voltage dependent resistor (VDR resistor).

An advantage of this improved preferred embodiment is that this circuit element reacts immediately to the ignition of the discharge tube. Namely, when the non-linear circuit element is a VDR resistor, it proceeds immediately after ignition of the discharge tube to its high-ohmic state. The control of the semiconductor switching element is then taken over by the first input branch of the control circuit.

The following should be considered as a further explanation as regards the starting procedure of the discharge tube in this improved preferred embodiment of an electric arrangement according to the invention. As mentioned above the r.m.s. value of the arc voltage (VB) of the discharge tube(s) differs only a little from the r.m.s. value of the AC supply voltage. If the input terminals of the improved preferred embodiment are connected to the AC supply voltage, the semiconductor switching element will be made conductive once by means of the first input branch, causing a current to flow which changes the capacitor which forms part of the stabilization ballast. In response to this charging procedure the voltage across the second input branch tries to assume a high value in the next half cycle of the AC supply, as a result of which the VDR resistor is brought to the low-ohmic state. This then prevents—owing to the fact that the semiconductor switching element is rapidly made conductive through the VDR-resistor—a high electric voltage from being produced between the electrodes of the discharge tube. This continues until the preheatable electrode is heated by means of the current which also flows through the semiconductor switching element and the discharge tube has subsequently been ignited. Except for this first triggering of the semiconductor switching element the first input branch has, therefore, no further function during the starting procedure of the discharge tube.

In the said improved embodiment it is therefore accomplished that during the starting procedure of the discharge tube the semiconductor switching element is made conductive predominantly by means of the second input branch, whereas in the operating condition of the discharge tube the semiconductor switching element is only made conductive by means of the first input branch. Thus, a separation has been established between the control procedure of the semiconductor switching element in the starting condition and in the operating condition of the discharge tube.

It is conceivable that the discharge tube of the electric arrangement is the sole discharge tube of that arrangement. If the available AC supply voltage is 220 volts, the arc voltage VB of that discharge tube is then close to the AC supply voltage, as the arc voltage may, namely, be between approximately 155 and 340 volts. This also means that the AC supply voltage is between the stipulated limits 0.65 VB and 1.4 VB. The high arc voltages may, for example, be realized by choosing a large electrode spacing of the discharge tube and/or by choosing a small diameter for that tube. The high arc voltage may alternatively be effected by means of finely distributed glass wool in the discharge tube.

In another preferred embodiment of an electric arrangement according to the invention, a second discharge tube is included in the series arrangement which interconnects the input terminals, whereby the circuit which includes the semiconductor switching element shunts the series-arranged discharge tubes.

An advantage of this preferred embodiment is that use can be made of discharge tubes having customary arc voltages. It would, for example, be possible to operate a series arrangement of two lamps, each having an arc voltage of approximately 105 volts, from a 220 volts supply source.

In an improvement of the said last preferred embodiment each of the two discharge tubes comprises two preheatable electrodes, the ends of the outermost electrodes which face away from the input terminals being interconnected through the semiconductor switching element.

This further improvement has the advantage that it combines the advantage of a multi-lamp device with the case where the semiconductor switching element can ensure preheating of two preheatable electrodes. The "outermost electrodes" must be understood to mean those electrodes of the discharge tubes which are disposed at the ends of the series arrangement of the two tubes.

In a further improvement of the said last preferred embodiment the two innermost electrodes are connected to an auxiliary transformer, the primary winding of the auxiliary transformer consisting of a portion of the stabilization ballast.

An advantage of this further improvement is that preheating of the two innermost electrodes of the discharge tubes can be effected in a simple manner. The relevant portion of the stabilization ballast ensuring electrode preheating is then an inductive portion.

In a further preferred embodiment of an electric device according to the invention the two discharge tubes are low-pressure mercury vapour discharge tubes.

An advantage of this preferred embodiment is that a simple lighting arrangement provided with a customary combination of discharge tubes requires only a small stabilization ballast and an electronic unit to operate those tubes.

The semiconductor switching element together with its control circuit may, for example, be implemented as a separate auxiliary device.

Such an auxiliary device preferably comprises three input terminals, two of those terminals being connected to a semiconductor switching element which has a bidirectional thyristor characteristic. A circuit comprising a non-linear circuit element and a capacitor shunts the semiconductor switching element. The third input terminal is connected to the capacitor through a resistor.

Such a preferred auxiliary device has the advantage that it is simple.

Figure 2:
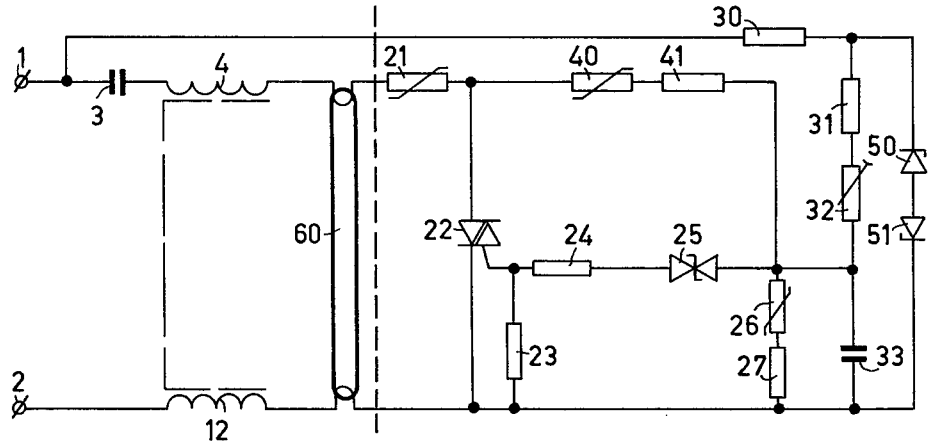

Some embodiments according to the invention will now be further explained with reference to the accompanying drawing in which:

FIG. 1 shows an electric circuit of a first electric arrangement according to the invention; and FIG. 2 shows an electric circuit of a second electric arrangement according to the invention.

In FIG. 1 reference numerals 1 and 2 denote input terminals intended for connection to an a.c. voltage source of approximately 220 volts, 50 Hertz. Terminal 1 is connected to a capacitor 3. The other side of the capacitor 3 is connected to a first primary winding 4 of a transformer 5. A secondary winding of the transformer is denoted by 5*a*. The other side of the winding 4 is connected to a preheatable electrode 6 of a low-pressure mercury vapour discharge tube 7. The tube 7 has a second preheatable electrode 8. A similar low-pressure mercury vapour discharge tube 9 is arranged in series with the tube 7. The tube 9 includes a preheatable electrode 10 and a preheatable electrode 11. The electrode 8 is connected to the electrode 10. The electrode 11 is connected through a second primary winding 12 of the transformer 5 to the input terminal 2. The windings 4 and 12 constitute the inductive portion of the stabilization ballast of the discharge tubes 7 and 9 and constitute a reactor. Of course, the winding 12 is not essential and a single winding 4 of appropriate value could be used instead of the pair of windings 4 and 12 shown.

The electrodes 6 and 11 are interconnected by a series arrangement of a positive temperature coefficient (PTC) resistor 21 and a semiconductor switching element 22 which has a bidirectional thyristor characteristic. A control electrode of the semiconductor switching element 22 is connected to the electrode 11 through a resistor 23. A junction of the control electrode of the semiconductor switching element 22 and the resistor 23 is connected to a resistor 24. The other side of the resistor 24 is connected to a breakdown element 25 which is implemented as a S.B.S. (silicon bilateral switch). The other side of the breakdown element 25 is connected to a temperature-sensitive resistor 26 having a negative temperature coefficient (NTC). The other side of this resistor 26 is connected to a resistor 27. The other side of the resistor 27 is connected to the electrode 11 of the discharge tube 9. A first input branch of the control circuit of the semiconductor switching element 22 consists of a series arrangement of a resistor 30, a resistor 31, a variable resistor 32 and a timing capacitor 33. One side of this input branch is connected to a junction between the input terminal 1 and the capacitor 3 and the other is connected to the electrode 11 of the discharge tube 9. A second input branch of the control circuit of the semiconductor switching element 22 consists of a series arrangement of a non-linear circuit element 40, which is implemented as a voltage-dependent resistor, a resistor 41 and the common capacitor 33. This second input branch shunts the semiconductor switching element 22.

In addition, the series arrangement of the resistors 31, 32 and the capacitor 33 is shunted by a series arrangement of two zener diodes 50 and 51 of opposite conductivity directions.

The connection of the transformer winding 5*a* to the electrodes 8 and 10 includes a switching element 60 having a bidirectional thyristor characteristic (Triac). A control electrode of this switching element 60 is connected to a main electrode of this switching element 60 through a series arrangement of two zener diodes 61 and 62.

The circuit operates as follows. When the terminals 1 and 2 are connected to the 220 volts 50 Hertz voltage source, a current will first flow in the circuit 1, 30, 31, 32, 33, 11, 12, 2, causing the capacitor 33 to be charged until the threshold value of the element 25 has been reached. Then the switching element 22 begins to conduct and capacitor 3 is charged (bias voltage). At the zero-crossing of the current the element 22 becomes non-conductive again. With the help of the bias voltage on the capacitor 3 a relatively high voltage is then produced between the electrodes 6 and 11. This voltage is so high that the voltage-dependent resistor 40 assumes its low-ohmic resistance value. In response thereto the capacitor 33 is charged very rapidly through the then relatively low-value resistor 40. As soon as the threshold voltage of the breakdown element 25 is reached again, the semiconductor switching element 22 is made conductive through its control electrode. Thereafter current flows through the circuit 1, 3, 4, 6, 21, 22, 11, 12 to input terminal 2. Owing to the fact that current also flows through the windings 4 and 12 a voltage will be induced in the winding 5*a*, which ensures that the electrodes 8 and 10 are also preheated. If the current through the element 22 falls below its hold current value at the end of a half cycle, this element again becomes non-conducting. In the manner described above the switching element 22 is made conductive again through the input circuit 40, 41, 33 in the subsequent half cycles. This process continues until the discharge tubes 7 and 9 ignite. Then the voltage between the electrodes 6 and 11 becomes equal to the combined arc voltages of the two tubes. This voltage is insufficient to keep the voltage-dependent resistor 40 in its low-ohmic state. In this situation the semiconductor switching element 22 is now made conductive by means of the first input branch 30, 31, 32, 33. During each half cycle of the AC supply the capacitor 33 is then charged through the resistors 30 to 32, inclusive, until the breakdown value of the threashold element 25 is reached. Then the control electrode of the switching element 22 receives a pulse in response to which this switching element becomes conductive. The capacitor 3, which forms part of the stabilization ballast, ensures inter alia that there is always a sufficient reignition voltage across the discharge tubes. By means of the series arrangement of the zener diodes 50 and 51 it is achieved that in the operating condition of the discharge tubes the instant in the half cycle at which the semiconductor switching element 22 is rendered conductive depends only to a small degree on variations in the AC voltage between the terminals 1 and 2.

To keep the AC current constant the first input branch is connected between the terminal 1 and the electrode 11. This means, namely, that the phase shift relative to the AC supply voltage, caused by the current through the winding 12, can be brought into account for adapting the moment at which the semiconductor switch 22 becomes conductive.

In the starting procedure of the discharge tubes 7 and 9 the operation of the input branch 30, 31, 32 is actually rapidly blocked, namely because at an early moment the capacitor 33 reaches the breakdown value of the threshold element 25 through the resistors 40 and 41. Also if, for any reason, the voltage across the electrodes 6 and 11 threatens to increase again to a high value, the resistor 40 ensures that the switching element 22 is made conductive sufficiently rapidly to prevent that high voltage from occurring.

If the discharge tubes 7 and 9 have been ignited, the voltage across the transformer winding 5*a* is reduced to such an extent that the breakdown value of the zener diodes 61 and 62 is no longer attained. This terminates the action of making the semiconductor switching element 60 conductive and, consequently, terminates the preheating of the innermost electrodes 8 and 10. Namely, in the operating condition of the tubes the temperature of the electrodes 8 and 10 is already kept at a sufficient level by the discharges in these two tubes 7 and 9. The NTC resistor 26 serves to guarantee the reignition of the discharge tubes, even at low ambient temperatures.

In a first practical embodiment, each discharge tube has a length of approximately 1.2 meter and a diameter of approximately 26 mm. The filling gas consists of argon. The arc voltage (VB) of each of the two lamps is approximately 125 volts. In that case each of the lamps consumes approximately 34 W. The stabilization ballast, consisting of the combination 3, 4, 12, consumes only approximately 9 W so that a total of 77 W is taken from the AC supply. The system efficiency, that is to say the efficiency of the entire electric arrangement including the ballast, is then approximately 88 lumen/watt. During the starting procedure the VDR resistor 40 proceeds to the low-ohmic state if a minimum voltage of approximately 350 volts appear between the tube electrodes. This prevents the tube from igniting while the electrodes are still cold. In an arrangement which does not follow the invention, i.e. one where the VDR resistor 40 is not present, but is the same in all other respects, the voltage between the tube electrodes 6 and 11 could increase to approximately 1200 volts. The discharge tube then ignited while the electrodes were still too cold.

In a second practical embodiment, wherein and AC supply is 118 volts and the AC frequency 60 Hertz, the length of each of the two discharge tubes was likewise 1.2 meter. This embodiment relates to low-pressure mercy vapour discharge lamps containing argon-Krypton and having an outside diameter of 38 mm. The arc voltage (VB) of, each of those two lamps is approximately 83 volts. In this case each lamp consumes approximately 32 watts. The stabilisation ballast consumes a total of approximately 7.5 watts, so 71.5 watts is consequently taken from the AC supply and the system efficiency is approximately 79 lumen/watt.

FIG. 2 shows a third embodiment wherein the arrangement is also intended for connection to a 118 volts, 60 Hertz AC supply, the two discharge tubes 7 and 9 of FIG. 1 being replaced by a single low-pressure mercury vapour discharge lamp 60 having a length of 1.5 meter. The remaining reference numerals in FIG. 2 correspond to those of FIG. 1. The outside diameter of the discharge tube 60 is 26 mm. The filling gas is argon. The arc voltage (VB) is approximately 145 volts. In this case the discharge tube consumes approximately 59 watts. The ballast consumes 8 watts. Consequently, approximately 67 watts is taken from the AC supply. The inner wall of the discharge tube is provided with a fluorescent layer containing trivalent europium-activated yttrium oxide, terbium-activated cerium magnesium aluminate and bivalent europium-activated barium magnesium aluminate (See U.K. Pat. Specification Nos. 1,458,700 and 1,452,083). The system efficiency is approximately 84 lumen/watt.

In the three above embodiments the circuit elements have approximately the values specified in the following table.

| | Embodiment | | |
|---|---|---|---|
| | No. 1 | No. 2 | No. 3 |
| Capacitor 3 (μF) | 3.4 | 7.8 | 6.5 |
| Capacitor 33 (nF) | 470 | 470 | 330 |
| Coils 4 and 12 together (Henry) | 1 | 0.33 | 0.35 |
| Resistor 41 (kOhm) | 39 | 39 | 100 |
| Resistor 32 (kOhm) | 11 | 11 | 10 |
| Resistor 31 (kOhm) | 39 | 39 | 15 |
| Resistor 30 (kOhm) | 100 | 47 | 47 |
| Resistor 27 (kOhm) | 27 | 27 | 27 |
| Resistor 24 (kOhm) | 150 | 150 | 150 |
| Resistor 23 (kOhm) | 1 | 1 | 1 |

The catalogue number of the VDR-resistor 40 is in the embodiments No. 1 and No. 3: Philips 2322594/14712; and in the embodiment No. 2: Philips 2322594/13512.

Each of the three embodiments satisfies the condition that the electrical device is connected to an AC supply voltage of between 0.65 VB and 1.4 VB. Namely, in the first embodiment the AC supply voltage is 220 volts and VB=2×125 volts=250 volts. The AC supply voltage is then between 0.65 VB=165 volts and 1.4 VB=350 volts. In the second embodiment the AC supply voltage is 118 volts and VB=2×83 volts=166 volts. The AC supply voltage is then between 0.65 VB=110 volts and 1.4 VB=230 volts. In the third embodiment the AC supply voltage is 118 volts and VB=145 volts. The AC supply voltage is then between 0.65 VB=95 volts and 1.4 VB=200 volts.

During the starting procedure the ohmic value of the VDR resistor 40 is in practice negligibly small in each of the embodiments. The remaining ohmic value of the resistor 41 is such that the time constant of the second input branch: 40, 41, 33 is so small that the capacitor 33 is rapidly charged via this branch and, consequently, the semiconductor switching element 22 is made conductive. In this phase of the starting procedure the first input branch including the resistors 30, 31 and 32 has no further function.

In addition, the circuit 30, 31 and 32 in each of the embodiments has such a high ohmic value that the voltage at the capacitor 33, in the operating condition of the discharge tube (discharge tubes), does not reach the breakdown voltage of the element 25 until the second half of each cycle of the electric supply at which time it then makes the semiconductor switching element 22 conductive to provide a path for filament current through tube electrodes 6 and 11.

The described arrangements according to the invention have the advantage that they use relatively small ballasts and, owing to the relatively high (combined) lamp arc voltages which are near the value of the AC supply voltage, and combined with starting circuits which ignite the discharge tubes in a manner which promote their life, lamp circuits are provided which save both energy and also material owing to the fact that they ignite the lamps in a manner which promotes their lives.

The circuit portion having the reference numerals 21 and upwards (in FIG. 1 and FIG. 2) can be accommodated in an envelope of the same dimensions as the envelope of a conventional glow discharge starter.

What is claimed is:

1. A supply circuit for igniting and operating at least one electric discharge tube provided with a preheatable electrode comprising, two input terminals for connection to an AC voltage source having an r.m.s. voltage value which lies between 0.65 VB and 1.4 VB, where VB is the total arc voltage of the discharge tube, means interconnecting and two input terminals by means of a series arrangement including the discharge tube and a stabilization ballast which includes a capacitor, means connecting an end of the preheatable electrode which faces away from the input terminals to another tube electrode included in the series arrangement through a circuit comprising a semiconductor switching element, a control circuit for making the switching element conductive in the operating condition of the discharge tube in the second half of each half cycle of the AC supply voltage, and a non-linear circuit element coupled to said tube electrodes, said non-linear circuit element having a lower resistance value when the input terminals are supplied with said AC supply voltage but the discharge tube has not yet ignited than it has in the operating condition of the discharge tube.

2. A supply circuit as claimed in claim 1 wherein the control circuit of the semiconductor switching element includes a first input branch connected to an input terminal and the non-linear circuit element is part of a second input branch of said control circuit, and wherein in the low-resistance state of the non-linear circuit element the time constant of the second input branch of the control circuit has a small value such that the semiconductor switching element is made conductive by said second input branch.

3. A supply circuit as claimed in claim 2 wherein the non-linear circuit element comprises a voltage dependent resistor.

4. A supply circuit as claimed in claims 1, 2 or 3 further comprising a second discharge tube included in the series arrangement which interconnects the input terminals and wherein the circuit comprising the semiconductor switching element is connected in shunt with the series-arranged discharge tubes.

5. A supply circuit as claimed in claim 4 wherein each of the two discharge tubes is provided with two preheatable electrodes with the ends of the outermost tube electrodes which face away from the input terminals being interconnected by the semiconductor switching element.

6. A supply circuit as claimed in claim 5 wherein the two discharge tubes comprise low-pressure mercury vapour discharge tubes.

7. A supply circuit as claimed in claim 5, wherein the two innermost electrodes of the discharge tubes are connected to an auxiliary transformer having a primary winding comprising a portion of the stabilization ballast.

8. A supply circuit as claimed in claim 7 wherein the two discharge tubes comprise low-pressure mercury vapour discharge tubes.

9. An auxiliary device for starting and operating at least one discharge tube having a preheatable electrode and connected in series circuit with a ballast including a capacitor across a pair of supply input terminals for connection to a source of AC supply voltage, the rms voltage value of the AC supply voltage lying in the range between 0.65 VB and 1.4 VB, where VB is the total discharge tube tube arc voltage in volts, the auxiliary device comprising three input terminals, means connecting two of said three input terminals to a semiconductor switching element having a bidirectional thyristor characteristic, means connecting a circuit comprising a non-linear circuit element and a timing capacitor in shunt with the semiconductor switching element, and means connecting and third input terminal to the timing capacitor through a resistor.

10. An electric arrangement for starting and operating at least one electric discharge tube provided with a preheatable electrode comprising, first and second input terminals for connection to a source of AC supply voltage having an r.m.s. voltage value between 0.65 VB and 1.4 VB, where VB is the total arc voltage in volts of the discharge tube, a stabilization ballast including a capacitor, means connecting a series arrangement of the ballast and the discharge tube across said first and second input terminals, a controlled semiconductor switching element having a control electrode, means connecting said switching element to said preheatable electrode and to another tube electrode included in said series arrangement so that the switching element provides a preheat current path for said preheatable electrode during a starting phase of the discharge tube, a control circuit coupled to said control electrode for making the switching element conductive during the starting phase of the discharge tube and for making it conductive in the second half of given half-cycles of the AC supply voltage in the operating condition of the discharge tube, said control circuit including a non-linear circuit element coupled to the tube electrodes and responsive to the tube voltage so as to vary its impedance level to vary the ignition point of the switching element in a half-cycle of the AC supply voltage during said tube starting phase so that the switching element limits the voltage developed across the tube electrodes to a value that prevents premature ignition of the discharge tube before the preheatable electrode has reached normal operating temperature.

11. An arrangement as claimed in claim 10 wherein the non-linear circuit element comprises a voltage-sensitive element coupled to the control electrode of the switching element.

12. An arrangement as claimed in claim 10 wherein the control circuit comprises first and second input branches each including means providing a time constant and with the second input branch including said non-linear circuit element, means connecting the first input branch between said first input terminal and said another tube electrode, means connecting the second input branch across the tube electrodes, said non-linear circuit element exhibiting a first low impedance state before the discharge tube ignites and a second high impedance state when the tube is in operation so that the time constant of the second input branch is less than and greater than the time constant of the first input branch during the starting phase and the operating condition, respectively, of the discharge tube whereby the second input branch controls the ignition point of the switching element during the starting phase and the first input branch controls the ignition point of the switching element during the operating condition of the discharge tube.

13. An arrangement as claimed in claims 10, 11 or 12 wherein the ballast includes said capacitor and a first inductor connected in series between said first input terminal and one tube electrode and a second inductor connected between said second input terminal and a second tube electrode.

14. An arrangement as claimed in claim 12 wherein said time constant providing means includes a timing capacitor connected in series with said non-linear circuit element in the second input branch and at least one resistor connected in series with said timing capacitor in the first input branch.

15. An arrangement as claimed in claim 12 wherein the second input branch further comprises a PTC resistor connected in series with the non-linear circuit element.

16. An arrangement as claimed in claims 10 or 11 wherein the control circuit further comprises a PTC resistor connected in series with the non-linear circuit element to said tube electrodes.

17. An arrangement as claimed in claims 10 or 11 wherein said another tube electrode comprises a second preheatable electrode of the discharge tube.

18. An arrangement as claimed in claims 10 or 11 wherein said another tube electrode comprises a preheatable electrode of a second electric discharge tube connected in series with the first discharge tube as a part of said series arrangement.

19. An arrangement as claimed in claim 10 wherein the control circuit comprises first and second input branches with the second input branch including said non-linear circuit element, means connecting the first input branch to one of said input terminals and the second input branch across the tube electrodes, said non-linear circuit element exhibiting a first low impedance state before the discharge tube ignites and a second high impedance state when the tube is in operation whereby the second input branch controls the ignition point of the switching element during the starting phase and the first input branch controls the ignition point of the switching element during the operating condition of the discharge tube.

20. An arrangement as claimed in claims 10, 11 or 12 wherein the control circuit further comprises a PTC resistor connected in series with said switching element across said tube electrodes to limit the current flow through said preheatable electrode if the discharge tube fails to ignite.

21. An arrangement as claimed in claims 10 or 12 wherein the control circuit further comprises a PTC resistor connected in series with said switching element and in series with said non-linear circuit element across said tube electrodes.

22. An arrangement as claimed in claim 10 wherein the control circuit includes an RC network having a time constant for controlling the operation of the switching element so that, during the operating condition of the discharge tube, a filament current flows through the switching element and the preheatable electrode during said given half-cycles of the AC supply voltage.

* * * * *

UNITED STATES PATENT AND TRADEMARK OFFICE

CERTIFICATE OF CORRECTION

PATENT NO. : 4,253,043

DATED : February 24,1981

INVENTOR(S) : Hubertus M.J. Chermin; et al

It is certified that error appears in the above-identified patent and that said Letters Patent are hereby corrected as shown below:

In the Specifications, Col. 1, Line 24, after "each" insert -- half--

Col. 1, Line 63, after "each" insert -- half--

Col. 5, Line 64, change "resistance" to read -- (resistance)--

Col. 8, Line 32, after "each" insert -- half--; after "supply" insert --,--

In the Claims, Col. 9, Line 48, after "discharge" delete "tube" (second occurrence).

Signed and Sealed this

Sixth Day of October 1981

[SEAL]

*Attest:*

GERALD J. MOSSINGHOFF

*Attesting Officer*

*Commissioner of Patents and Trademarks*